US007535442B2

(12) United States Patent
Yamashita et al.

(10) Patent No.: US 7,535,442 B2
(45) Date of Patent: May 19, 2009

(54) PIXEL CIRCUIT, DISPLAY AND DRIVING METHOD THEREOF

(75) Inventors: Junichi Yamashita, Tokyo (JP); Katsuhide Uchino, Kanagawa (JP); Tetsuro Yamamoto, Kanagawa (JP); Naobumi Toyomura, Kanagawa (JP)

(73) Assignee: Sony Corporation (JP)

( * ) Notice: Subject to any disclaimer, the term of this patent is extended or adjusted under 35 U.S.C. 154(b) by 845 days.

(21) Appl. No.: 11/226,320

(22) Filed: Sep. 15, 2005

(65) Prior Publication Data

US 2006/0061560 A1 Mar. 23, 2006

(30) Foreign Application Priority Data

Sep. 17, 2004 (JP) ..... P2004-270786

(51) Int. Cl.
*G09G 3/30* (2006.01)

(52) U.S. Cl. ..... 345/76; 315/169.3

(58) Field of Classification Search ..... 345/76–83, 345/204; 315/169.3

See application file for complete search history.

(56) References Cited

U.S. PATENT DOCUMENTS 7,122,970 B2 * 10/2006 Ono et al. ..... 315/169.3
2004/0070557 A1 * 4/2004 Asano et al. ..... 345/76

FOREIGN PATENT DOCUMENTS

| | | |
|---|---|---|
| JP | 2003-255856 | 9/2003 |
| JP | 2003-271095 | 9/2003 |
| JP | 2004-029791 | 1/2004 |
| JP | 2004-093682 | 3/2004 |
| JP | 2004-133240 | 4/2004 |

* cited by examiner

*Primary Examiner*—Amr Awad
*Assistant Examiner*—Jarurat Suteerawongsa
(74) *Attorney, Agent, or Firm*—Rader Fishman & Grauer PLLC; Ronald P. Kananen

(57) ABSTRACT

The invention provides a pixel circuit that allows simultaneous correction of both influence of the threshold voltage of a drive transistor and influence of the mobility of the drive transistor. Correction means is connected to a drive transistor and a capacitance part, and operates during a correction period preceding to a sampling period. The correction period is separated into a reset period and a detection period. During the reset period, the correction means energizes the capacitance part to reset the potential of the capacitance part. During the detection period, the correction means stops the energization and detects the potential difference arising between the source and gate of the drive transistor during the period when a transient current flows through the drive transistor. The capacitance part holds the potential corresponding to the detected potential difference. The held potential includes both a potential component for reducing the influence of the threshold voltage on the output current of the drive transistor, and a potential component for reducing the influence of the carrier mobility thereon.

11 Claims, 11 Drawing Sheets

$$Iref = \frac{1}{2} k\mu (Vs - Vofs - |Vth|)^2 \quad \text{EQUATION 4}$$

$$Va = Vs - Vofs - |Vth| = \sqrt{\frac{2Iref}{k\mu}} \quad \text{EQUATION 5}$$

$$Ids = \frac{1}{2} \mu \frac{W}{L} Cox \left( Vcc - Vsig + \sqrt{\frac{2Iref}{k\mu}} \right)^2 \quad \text{EQUATION 6}$$

PIXEL CIRCUIT, DISPLAY AND DRIVING METHOD THEREOF

BACKGROUND OF THE INVENTION

The present invention relates to a pixel circuit for current-driving a light-emitting element provided for each pixel. The invention also relates to a display that includes the pixel circuits arranged in a matrix, and particularly to an active-matrix display that controls the amount of a current applied to a light-emitting element, such as an organic electro-luminescence (EL) element, by use of insulated-gate field effect transistors provided in the respective pixel circuits.

In an image display, e.g., a liquid crystal display, plural liquid crystal pixels are arranged in a matrix, and the transmitted intensity or reflected intensity of incident light is controlled for each pixel based on information of images to be displayed, to thereby display the images. The similar principle also holds for an organic EL display employing organic EL elements for its pixels. The organic EL element is a self-emitting element unlike the liquid crystal element. Therefore, the organic EL display has advantages over the liquid crystal display: high image visibility, no backlight, and high response speed. Furthermore, the organic EL display is a current-control display, which can control the luminance level (gray-scale) of each light-emitting element with the amount of a current applied to the emitting element, and therefore is significantly different from the liquid crystal display, which is a voltage-control display.

The organic EL display is driven with a simple-matrix or active-matrix method as with the liquid crystal display. The simple-matrix method employs a simple structure, but involves difficulties of fabricating large-size and high-definition displays. Therefore, the active-matrix displays have been developed more actively in recent years. In the active-matrix method, a current applied to a light-emitting element in each pixel circuit is controlled by an active element (typically a thin film transistor (TFT)) provided in the pixel circuit. Examples of the active-matrix method have been disclosed in Japanese Patent Laid-Opens No. 2003-255856, 2003-271095, 2004-133240, 2004-029791, and 2004-093682.

Conventional pixel circuits are disposed at intersections between row scan lines that supply control pulses and column signal lines that supply video signals. Each pixel circuit includes at least a sampling transistor, a capacitance part, a drive transistor and a light-emitting element. The sampling transistor conducts in response to the control pulse supplied from the scan line to sample the video signal supplied from the signal line. The capacitance part holds an input potential dependent upon the sampled video signal. The drive transistor supplies an output current during a certain emission period according to the input potential held by the capacitance part. Typically the output current has dependence on the carrier mobility in the cannel region of the drive transistor and dependence on the threshold voltage of the drive transistor. The output current supplied from the drive transistor causes the light-emitting element to emit light with a luminance dependent upon the video signal.

The drive transistor receives at the gate thereof the input potential held by the capacitance part to flow the output current between the source and drain, to thereby apply a current to the light-emitting element. Typically the emission luminance of the light-emitting element is proportional to the applied current amount. In addition, the amount of the output current supplied from the drive transistor is controlled with the gate voltage, i.e., the input potential written to the capacitance part. The conventional pixel circuit changes the input voltage applied to the gate of the drive transistor according to the input video signal, to thereby control the amount of a current supplied to the light-emitting element.

The operating characteristic of the drive transistor is expressed by the following equation.

$$Ids=(1/2)\mu(W/L)Cox(Vgs-Vth)^2 \quad \text{Equation 1}$$

In Transistor Characteristic Equation 1, Ids denotes a drain current flowing between the source and drain. The drain current corresponds to the above-described output current supplied to the light-emitting element in the pixel circuit. Vgs denotes a voltage applied to the gate (gate-applied voltage) with reference to the potential of the source. The gate-applied voltage corresponds to the above-described input potential in the pixel circuit. Vth denotes the threshold voltage of the transistor. μ denotes the mobility in a semiconductor thin film constituting the channel of the transistor. In addition, W, L and Cox denote the channel width, channel length and gate capacitance, respectively. As is apparent from Transistor Characteristic Equation 1, when a thin film transistor operates in the saturated region, a gate voltage Vgs higher than the threshold voltage Vth turns on the transistor to flow the drain current Ids. In principle, a constant gate voltage Vgs invariably provides the same drain current Ids to the light-emitting element as indicated by Transistor Characteristic Equation 1. Therefore, supplying the same level input signal to all pixels of a screen should cause all the pixels to emit light with the same luminance, and thus should achieve the uniformity of the screen.

In fact, however, there are variations in device characteristics among TFTs formed of a semiconductor thin film, such as a poly-silicon thin film. In particular, the threshold voltage Vth is not constant but varies from pixel to pixel. As is apparent from Transistor Characteristic Equation 1, even if the gate-applied voltage Vgs is constant, variation in the threshold voltage Vth among the drive transistors leads to variation in the drain current Ids. Thus, the luminance varies depending on each pixel, which spoils the uniformity of the screen. Conventionally, there has been developed a pixel circuit that has a function of canceling variation in the threshold voltage among drive transistors. For example, such a pixel circuit is disclosed in the above-mentioned Japanese Patent Laid-Open No. 2004-133240.

The pixel circuit provided with the function of canceling variation in the threshold voltage can improve the uniformity of a screen to some extent. However, of the characteristics of poly-silicon TFTs, not only the threshold voltage but also the mobility μ vary depending on each element. As Transistor Characteristic Equation 1 shows, variation in the mobility μ results in variation in the drain current Ids even if the gate-applied voltage Vgs is constant. As a result, the emission luminance varies from pixel to pixel, problematically spoiling the uniformity of a screen.

SUMMARY OF THE INVENTION

In consideration of such a problem of the related art, the present invention intends to provide a pixel circuit, a display, and a driving method thereof that each allows simultaneous correction of influence of both the threshold voltage and mobility, to thereby permit compensation of variation in the drain current (output current) supplied from the drive transistor. To this end, the following configuration is implemented. Specifically, according to an embodiment of the invention, there is provided a pixel circuit disposed at an intersection between a row scan line that supplies a control pulse and a column signal line that supplies a video signal. The pixel circuit includes a sampling transistor conducting in response to the control pulse supplied from the scan line to sample the video signal supplied from the signal line during a certain sampling period, a capacitance part holding an input potential dependent upon the sampled video signal, and a drive transistor supplying an output current during a certain emission period according to the input potential held by the capacitance part. The output current has dependence on a carrier mobility in a channel region of the drive transistor and dependence on a threshold voltage of the drive transistor. The pixel circuit also includes a light-emitting element caused, by the output current supplied from the drive transistor, to emit light with a luminance in response to the video signal, and correction means correcting both the dependence of the output current on the carrier mobility and the dependence of the output current on the threshold voltage simultaneously. The correction section is connected to the drive transistor and the capacitance part, and operates during a correction period preceding to the sampling period. The correction period is separated into a reset period and a detection period. During the reset period, the correction section energizes the capacitance part to reset the potential held by the capacitance part. During the detection period, the correction section stops the energization and detects a potential difference arising between a source and a gate of the drive transistor during a period when a transient current flows through the drive transistor. The capacitance part holds a potential corresponding to the detected potential difference. The held potential includes both a potential component for reducing influence of the threshold voltage on the output current of the drive transistor, and a potential component for reducing influence of the carrier mobility on the output current of the drive transistor.

Furthermore, according to an embodiment of the invention, there is provided a display that includes a pixel array part having scan lines disposed on rows, signal lines disposed on columns, and a matrix of pixels disposed at intersections between the scan and signal lines, a signal part supplying a video signal to the signal lines, and a scanner part supplying a control pulse to the scan lines to sequentially scan the pixels for each row. Each of the pixels includes at least a sampling transistor, a capacitance part, a drive transistor, and a light-emitting element. The sampling transistor conducts in response to a sampling control pulse supplied from the scan line to sample the video signal supplied from the signal line during a certain sampling period. The capacitance part holds an input potential dependent upon the sampled video signal. The drive transistor supplies an output current during a certain emission period according to the input potential held by the capacitance part. The output current has dependence on a carrier mobility in a channel region of the drive transistor and dependence on a threshold voltage of the drive transistor. The light-emitting element is caused, by the output current supplied from the drive transistor, to emit light with a luminance in response to the video signal. Each of the pixels includes correction means that corrects both the dependence of the output current on the carrier mobility and the dependence of the output current on the threshold voltage simultaneously. The correction section is connected to the drive transistor and the capacitance part, and operates during a correction period preceding to the sampling period. The correction period is separated into a reset period and a detection period. During the reset period, the correction section energizes the capacitance part to reset the potential held by the capacitance part. During the detection period, the correction section stops the energization and detects a potential difference arising between a source and a gate of the drive transistor during a period when a transient current flows through the drive transistor. The capacitance part holds a potential corresponding to the detected potential difference. The held potential includes both a potential component for reducing influence of the threshold voltage on the output current of the drive transistor, and a potential component for reducing influence of the carrier mobility on the output current of the drive transistor. The scanner part includes at least a write scanner, a drive scanner, and a correction scanner. The write scanner supplies the sampling control pulse to the scan lines during the sampling period. The correction scanner supplies a correction control pulse that defines the correction period to the scan lines. The drive scanner supplies a drive control pulse to the scan lines. The drive control pulse differentiates the reset period from the detection period in the correction period and differentiates an emission period from a non-emission period other than the emission period.

Moreover, according to an embodiment of the invention, there is provided a method of driving a pixel circuit disposed at an intersection between a row scan line that supplies a control pulse and a column signal line that supplies a video signal. The pixel circuit includes at least a sampling transistor, a capacitance part, a drive transistor and a light-emitting element. The sampling transistor conducts in response to the control pulse supplied from the scan line to sample the video signal supplied from the signal line during a certain sampling period. The capacitance part holds an input potential dependent upon the sampled video signal. The drive transistor supplies an output current during a certain emission period according to the input potential held by the capacitance part. The output current has dependence on a carrier mobility in a channel region of the drive transistor and dependence on a threshold voltage of the drive transistor. The light-emitting element is caused, by the output current supplied from the drive transistor, to emit light with a luminance in response to the video signal. The method includes a correction step for correcting both the dependence of the output current on the carrier mobility and the dependence of the output current on the threshold voltage simultaneously during a correction period preceding to the sampling period. The correction period is separated into a reset period and a detection period. The correction step includes the sub steps of: energizing the capacitance part to reset the potential held by the capacitance part during the reset period; and stopping the energization and detecting a potential difference arising between a source and a gate of the drive transistor during a period when a transient current flows through the drive transistor during the detection period. The method also includes a holding step for holding a potential corresponding to the detected potential difference in the capacitance part. The held potential includes both a potential component for reducing influence of the threshold voltage on the output current of the drive transistor, and a potential component for reducing influence of the carrier mobility on the output current of the drive transistor.

In addition, according to an embodiment of the invention, there is provided a method of driving a display including a pixel array part, a scanner part and a signal part. The pixel array part includes scan lines disposed on rows, signal lines disposed on columns, and a matrix of pixels disposed at intersections between the scan and signal lines. The signal part supplies a video signal to the signal lines. The scanner part supplies a control pulse to the scan lines to sequentially scan the pixels for each row. Each of the pixels includes at least a sampling transistor, a capacitance part, a drive transistor and a light-emitting element. The sampling transistor conducts in response to a sampling control pulse supplied from the scan line to sample the video signal supplied from the signal line during a certain sampling period. The capacitance part holds an input potential dependent upon the sampled video signal. The drive transistor supplies an output current during a certain emission period according to the input potential held by the capacitance part. The output current has dependence on a carrier mobility in a channel region of the drive transistor and dependence on a threshold voltage of the drive transistor. The light-emitting element is caused, by the output current supplied from the drive transistor, to emit light with a luminance in response to the video signal. The method includes a correction step for correcting at each pixel both the dependence of the output current on the carrier mobility and the dependence of the output current on the threshold voltage simultaneously during a correction period preceding to the sampling period. The correction period is separated into a reset period and a detection period. The correction step includes the sub steps of: energizing the capacitance part to reset the potential held by the capacitance part during the reset period; and stopping the energization and detecting a potential difference arising between a source and a gate of the drive transistor during a period when a transient current flows through the drive transistor during the detection period. The method also includes a holding step for holding a potential corresponding to the detected potential difference in the capacitance part. The held potential includes both a potential component for reducing influence of the threshold voltage on the output current of the drive transistor, and a potential component for reducing influence of the carrier mobility on the output current of the drive transistor. The method further includes a write scanning step for supplying the sampling control pulse to the scan lines during the sampling period, a correction scanning step for supplying a correction control pulse that defines the correction period to the scan lines, and a drive scanning step for supplying a drive control pulse to the scan lines. The drive control pulse differentiates the reset period from the detection period in the correction period and differentiates an emission period from a non-emission period other than the emission period.

According to an embodiment of the invention, the pixel circuit corrects both the dependence of the output current on the carrier mobility and that on the threshold voltage simultaneously. Specifically, in a certain detection period, the potential difference arising between the source and gate of the drive transistor is detected during the period when a transient current for detection flows through the drive transistor, and the detected potential difference is fed back to the capacitance part. Since the detection period is set shorter than conventional one, the potential difference between the source and gate can be detected while the transient current is flowing. As a result, the potential corresponding to the detected potential difference includes a potential component for reducing the influence of the carrier mobility on the output current of the drive transistor as well as a potential component for reducing the influence of the threshold voltage thereon. If the detection period is long and therefore the potential difference between the source and gate is detected after the transient current has disappeared as is conventional, the resulting potential includes only a potential component for reducing the influence of the threshold voltage. Detecting the potential difference in the current-flowing state allows acquisition of information relating to the carrier mobility. Since the influence of the threshold voltage and mobility can be eliminated for each pixel, variation in the output current among pixels can be suppressed over the entire pixel array. In particular, the dependence of the output current on the mobility is high when displaying a gray-scale in a range of gray to white. According to an embodiment of the invention, variation in the output current due to the mobility variation can be suppressed, and thus the uniformity of the screen can be significantly improved when displaying a gray-scale in a range of gray to white. According to an embodiment of the invention, adequate timing control is implemented with maintaining the conventional pixel circuit configuration basically, to thereby allow correction of both threshold voltage variation and mobility variation. Therefore, variation in the output current can be suppressed without increasing the number of elements in the pixel circuit.

In addition, According to an embodiment of the invention, the potential held by the capacitance part is reset during the reset period preceding to the detection period in order to stably detect the transient current flowing through the drive transistor. This reset operation flows a through-current in the drive transistor although instantaneous, which causes anomalous light-emission of the light-emitting element. This anomalous emission is unnoticeable when displaying a gray-scale in a range of gray to white. However, when displaying black, this anomalous emission problematically causes so-called "floating black", spoiling the contrast on the screen. The embodiments of the invention minimize the time length of the reset period for suppressing the through-current, to thereby prevent "floating black".

DETAILED DESCRIPTION OF THE PREFERRED EMBODIMENTS

Figure 1:
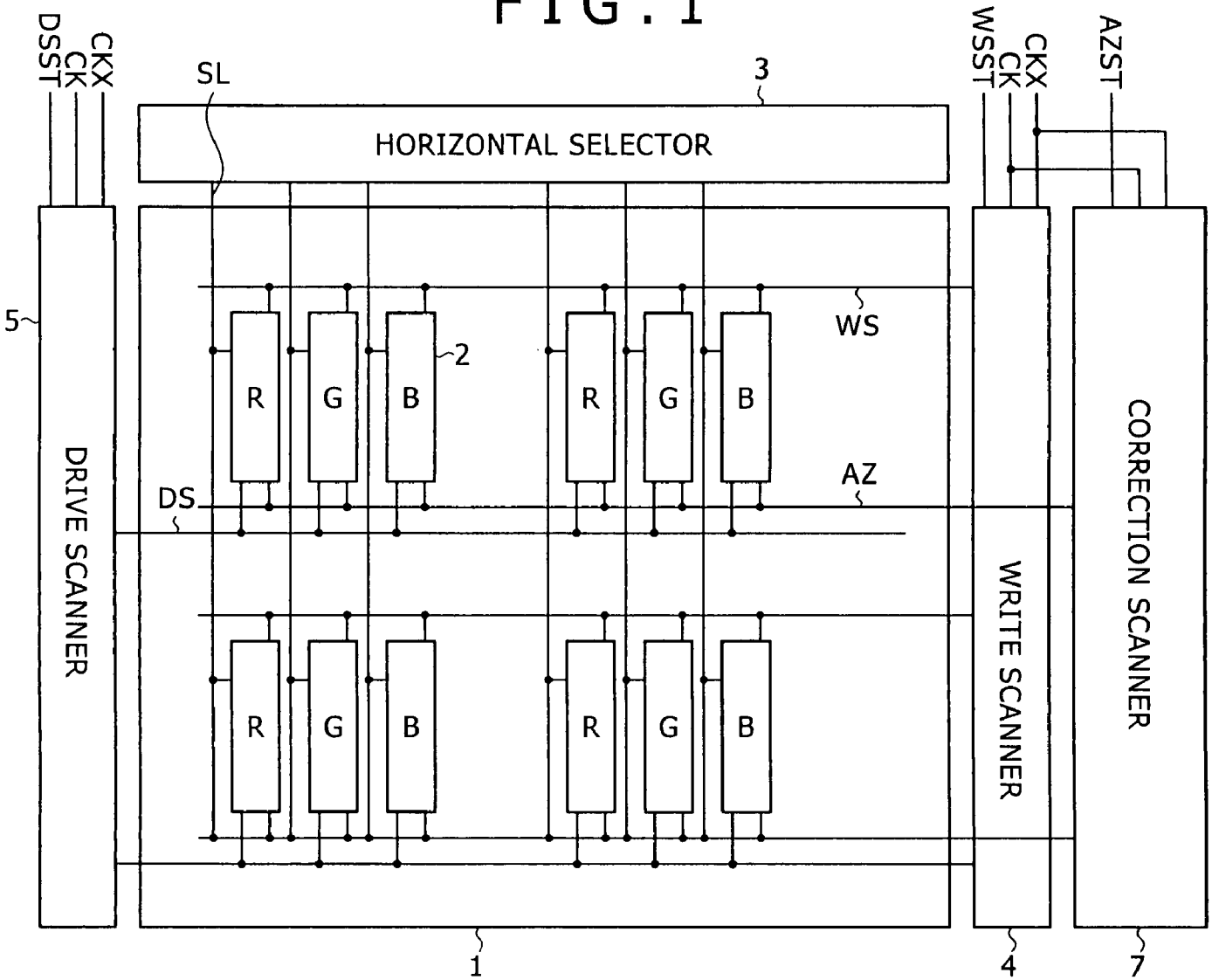
FIG. 1 is a block diagram illustrating the basic configuration of a display according to an embodiment of the present invention.

Embodiments of the present invention will be described in detail below with reference to the accompanying drawings. Initially, in order to clearly show the concept of the invention, the basic configuration of an active-matrix display will be described with reference to FIG. 1. Referring to FIG. 1, the active-matrix display is composed of a pixel array 1, which is an essential part, and peripheral circuit parts. The peripheral circuit parts include a horizontal selector 3, a write scanner 4, a drive scanner 5, a correction scanner 7, and so on. The pixel array 1 is composed of row scan lines WS, column signal lines SL, and pixels R, G and B that are disposed in a matrix at intersections between the scan and signal lines. Although this display includes pixels of three primary colors of RGB to allow color displaying, the present invention is not limited thereto. Each of the pixels R, G and B is composed of a pixel circuit 2. The signal lines SL are driven by the horizontal selector 3. The horizontal selector 3 constitutes a signal part, and supplies video signals to the signal lines SL. The scan lines WS are scanned by the write scanner 4. Other scan lines DS and AZ are also provided parallel to the scan lines WS. The scan lines DS are scanned by the drive scanner 5. The scan lines AZ are scanned by the correction scanner 7. The write scanner 4, the drive scanner 5 and the correction scanner 7 constitute a scanner part, and sequentially scan one of the respective rows in each one horizontal period. Each pixel circuit 2 samples the video signal from the signal line SL when selected by the scan line WS. Furthermore, the pixel circuit 2 drives a light-emitting element included therein according to the sampled video signal, when selected by the scan line DS. In addition, the pixel circuit 2 implements predetermined correction operation when scanned by the scan line AZ.

The write scanner 4 is composed of a shift register basically. The write scanner 4 operates in response to externally supplied clock signals CK and CKX having opposite polarities, to sequentially transfer an externally supplied sampling start pulse WSST in each one horizontal period. Thus, the write scanner 4 sequentially outputs a sampling control pulse to the scan lines WS for the pixels of the respective rows. Similarly the drive scanner 5 is also composed of a shift register, and sequentially transfers in each one horizontal period, a drive start pulse DSST in response to the clock signals CK and CKX, to thereby output a drive control pulse to the scan lines DS for the pixels of the respective rows. The correction scanner 7 is also composed of a shift register, and sequentially transfers in synchronized with the clock signals CK and CKX, an externally supplied correction start pulse AZST, to thereby output a correction control pulse to the pixels of the respective rows. As shown in the drawing, the clock signals CK and CKX are commonly supplied to the write scanner 4, the drive scanner 5 and the correction scanner 7 of the scanner part. In contrast, the start pulses WSST, DSST and AZST have different waveforms depending on the function of the respective scanners.

The pixel array 1 is typically formed on an insulating substrate, such as a glass substrate, to form a flat panel. Each pixel circuit 2 is made of amorphous-silicon TFTs or low-temperature poly-silicon TFTs. If the pixel circuit 2 is made of the amorphous-silicon TFTs, the scanner part is formed on a tape automated bonding (TAB) base separated from the flat panel, followed by being connected to the flat panel via a flexible cable. If the pixel circuit 2 is made of the low-temperature poly-silicon TFTs, since the scanner part is also formed of the low-temperature poly-silicon TFTs, the pixel array part and scanner part can be formed on the same flat panel integrally. In either case, typically the clock pulses CK and CKX are commonly supplied to the scanners 4, 5 and 7 as described above, in order to reduce the number of kinds of input clock pulses.

Figure 2:
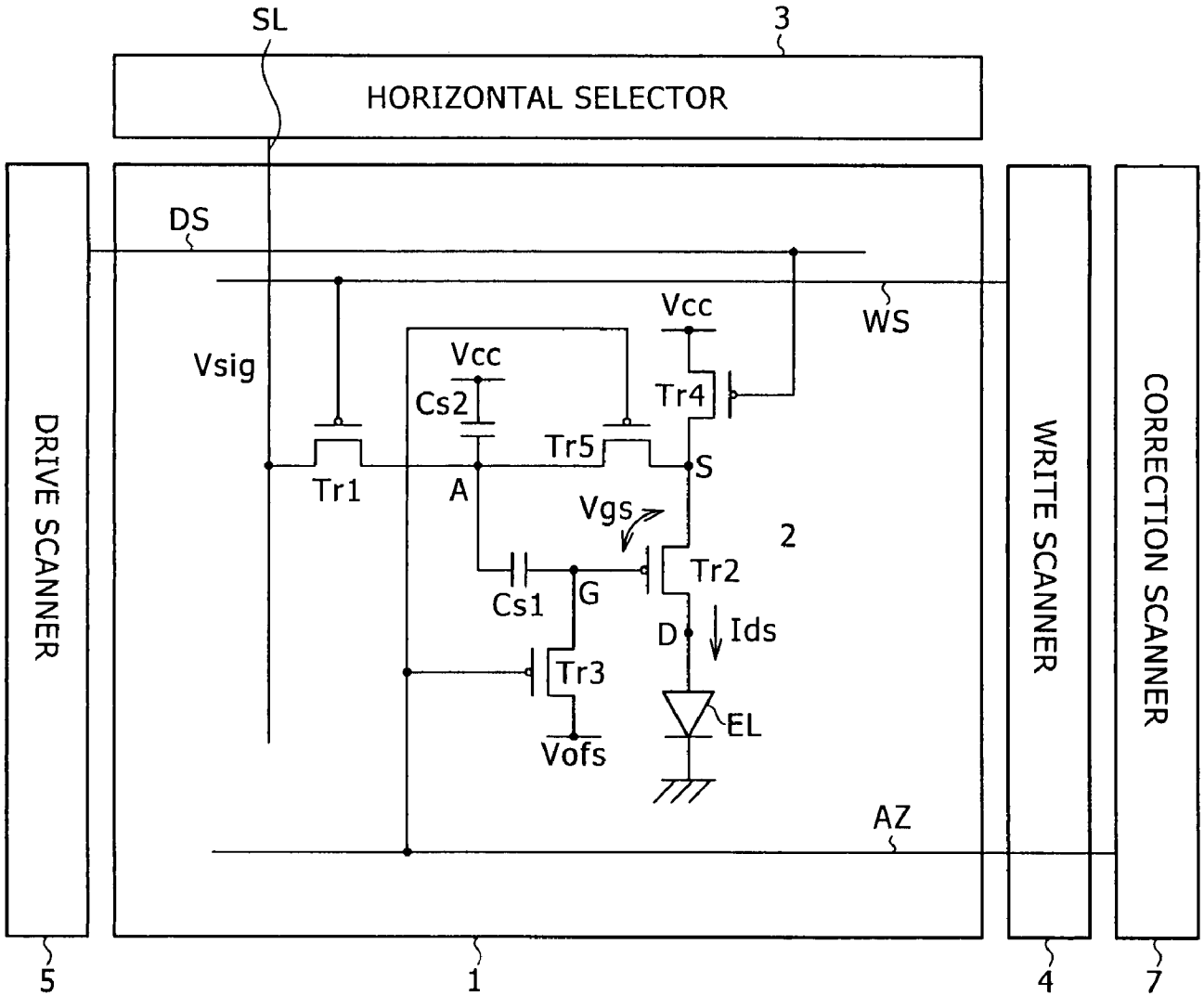
FIG. 2 is a circuit diagram illustrating the configuration of a pixel circuit included in the display of FIG. 1.

FIG. 2 is a circuit diagram illustrating the basic configuration of the pixel circuit included in the pixel array shown in FIG. 1. Referring to FIG. 2, the pixel circuit 2 is composed of five thin film transistors Tr1 to Tr5, two capacitance elements Cs1 and Cs2, and one light-emitting element EL. All of the transistors Tr1 to Tr5 are a P-channel poly-silicon TFT. However, the present invention is not limited thereto. The transistors may also include N-cannel poly-silicon TFTs. Alternatively, the pixel circuit may be composed of N-cannel amorphous-silicon TFTs. Two capacitance elements Cs1 and Cs2 integrally constitute the capacitance part of the pixel circuit 2. The light-emitting element EL is a dual-terminal organic EL element with an anode and cathode for example. However, the present invention is not limited thereto. The light-emitting element encompasses all devices that are current-driven to emit light.

The gate (G) of the drive transistor Tr2, which is central to the pixel circuit 2, is connected to a point G. The source (S) and drain (D) thereof are connected to points S and D, respectively. The anode of the light-emitting element EL is connected to the point D, while the cathode thereof is grounded. The switching transistor Tr4 is connected between a supply potential Vcc and the point S, and controls switching on and off of the light-emitting element EL. The gate of the transistor Tr4 is connected to the scan line DS.

The sampling transistor Tr1 is connected between the signal line SL and a point A. The gate of the sampling transistor Tr1 is connected to the scan line WS. Connected between the points A and S is the detection transistor Tr5. The gate thereof is connected to the scan line AZ. The switching transistor Tr3 is connected between the point G and a certain offset potential Vofs. The gate thereof is connected to the scan line AZ. The detection transistor Tr5 and the switching transistor Tr3 constitute a correction section for canceling the threshold voltage Vth. One capacitance element Cs1 is connected between the points A and G, while the other capacitance element Cs2 is connected between the supply potential Vcc and the point A.

The drive transistor Tr2 flows the drain current Ids between the source and drain according to the gate voltage Vgs applied between the source and gate, to thereby drive the light-emitting element EL with the drain current Ids. In the present specification, the gate voltage Vgs and the drain current Ids are defined as the input potential and output current, respectively. The gate voltage Vgs is defined based on the video signal Vsig supplied from the signal line SL, and the drain current Ids is applied based on the gate voltage Vgs. Thus, the emission luminance of the light-emitting element EL can be controlled according to the gray-scale of the video signal.

The threshold voltage Vth of the drive transistor Tr2 varies depending on each pixel. In order to cancel this variation, the threshold voltage Vth of the drive transistor Tr2 is detected and stored in the capacitance element Cs1 in advance. Subsequently, the sampling transistor Tr1 is turned on to write the signal potential Vsig to the capacitance element Cs2. The drive transistor Tr2 is driven with the gate potential Vgs defined by thus obtained Vth and Vsig.

Figure 3:
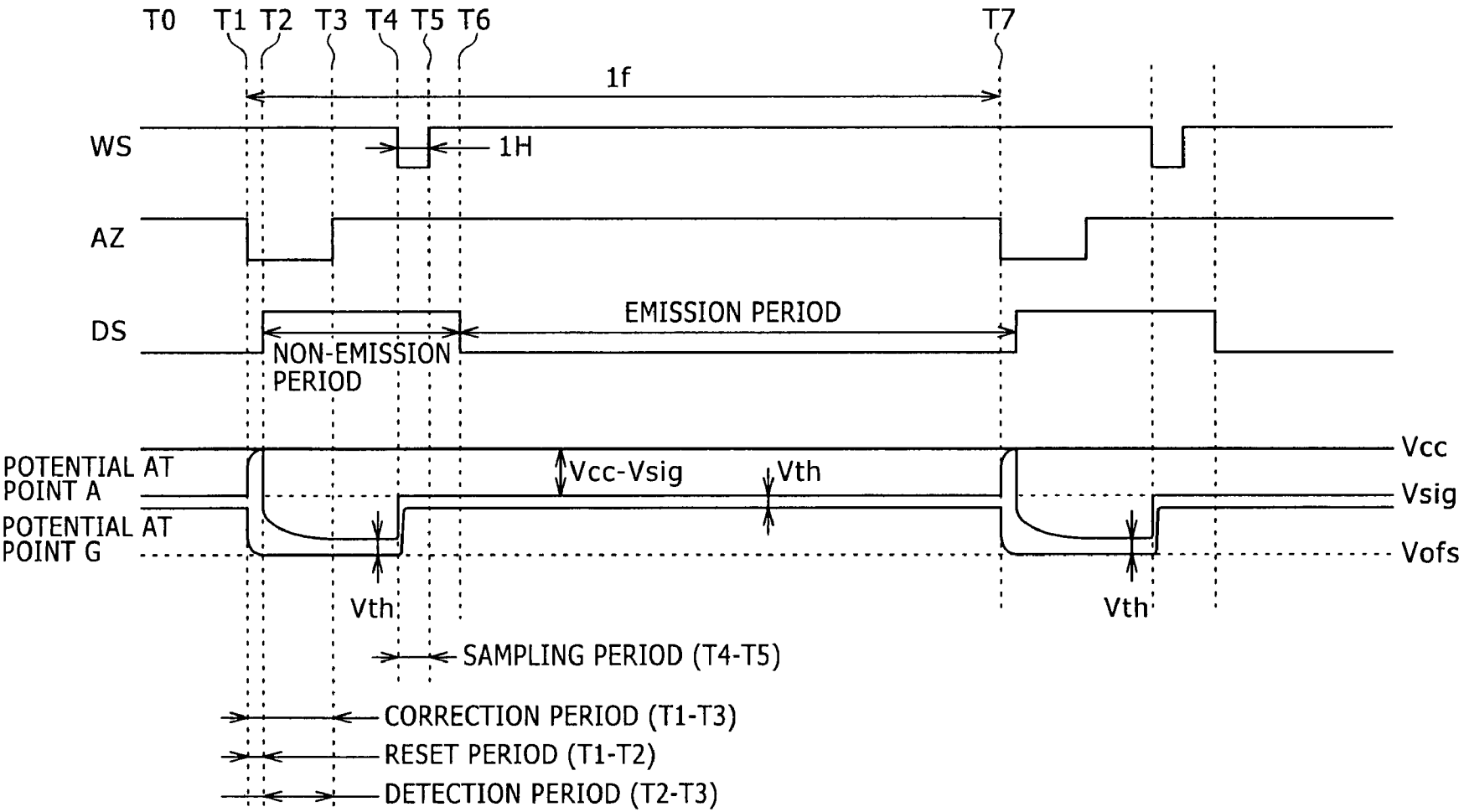
FIG. 3 is a referential timing chart explaining the operation of the pixel circuit of FIG. 2.

FIG. 3 is a timing chart explaining the operation of the pixel circuit of FIG. 2. FIG. 3 illustrates along a time axis T, the waveforms of control pulses applied to the scan lines WS, AZ and DS. For simplified description, each control pulse is given the same numeral as that of the corresponding scan line. Since all the transistors are a P-channel transistor, the transistor is "off" when the scan line is at the high level, and is "on" when at the low level. Therefore, for simplified description, fall down of the control pulse from the high level to the low level will be referred to as "on", while rise up from the low level to the high level will be referred to as "off", hereinafter. FIG. 3 also illustrates potential changes at the points A and G associated with the waveforms of the control pulses WS, AZ and DS.

In the timing chart, the period from timing T1 to T7 is defined as one field (1f). During one field, each row of the pixel array is sequentially scanned once. The timing chart illustrates the waveforms of the control pulses WS, AZ and DS applied to the pixels of one row.

At timing T0, which is prior to the start of one field, the control pulses WS and AZ are "off", while the control pulse DS is "on". Therefore, the sampling transistor Tr1, the detection transistor Tr5 and the switching transistor Tr3 are in the off-state while only the switching transistor Tr4 is in the on-state. In this state, the point A is at the signal potential Vsig, and the point G is at the potential lower than Vsig by Vth. At this time, the point S is at Vcc since the transistor Tr4 is in the on-state. Therefore, a sufficient voltage higher than Vth is applied between the source and gate of the transistor Tr2, which supplies the output current Ids to the light-emitting element EL. Thus, the light-emitting element EL is in the emission state at the timing T0.

Subsequently, at the timing T1, which is the start of the field, the control pulse AZ is switched on and thus the transistors Tr5 and Tr3 are turned on. This operation directly couples the points A and S to each other, and therefore the potential at the point A sharply rises up toward the supply potential Vcc. In addition, since the transistor Tr3 is turned on, the potential at the point G sharply falls down toward the certain offset potential Vofs.

At the timing T2 immediately after the timing T1, the control pulse DS is turned off and thus the switching transistor Tr4 enters the non-conductive state. This operation isolates the point S from the supply potential Vcc, which turns the light-emitting element to the non-emission state. During a period T1-T2 from the timing T1 to T2, the potential at the point A reaches Vcc while the potential at the point G reaches Vofs. Therefore, the potentials of the capacitance elements Cs1 and Cs2 are reset. This reset operation serves as a preparation for stabilizing the subsequent detection operation. The period T1-T2 is referred to as a reset period in the present specification.

Since the switching off of the control pulse DS at the timing T2 isolates the point S from Vcc, the power feed from the power supply is interrupted and discharging of the capacitance element Cs1 is initiated to flow a transient current via the transistor Tr5, which lowers the potential at the point A from Vcc. The transient current disappears when the potential at the point A drops to the potential higher by Vth than the potential at the point G. As a result, the potential difference between the points A and G becomes Vth, and the potential Vth is stored in the capacitance element Cs1.

At the timing T3, the control pulse AZ is turned off. Therefore, the transistors Tr5 and Tr3 are turned off, which isolates the capacitance Cs1 from Vofs and the point S. Since Vth is detected and stored in Cs1 during the period from the timing T2 to T3, a period T2-T3 is referred to as a detection period in the present specification. The detection period T2-T3 has a sufficient long time length so that the transient current flowing through the drive transistor falls off to zero.

As described above, the reset operation during the reset period T1-T2 and the detection operation during the detection period T2-T3 serve as the correction operation for the threshold voltage Vth. Thus, a period T1-T3, which is the sum of the reset and detection periods, is referred to as a correction period in the present specification. As is apparent from the timing chart of FIG. 3, the correction period T1-T3 is defined by the control pulse AZ. In addition, the control pulse DS differentiates the reset period T1-T2 from the detection period T2-T3 in the correction period T1-T3. The control pulse DS basically controls switching on and off of the switching transistor Tr4, and therefore defines the non-emission period and emission period.

At the timing T4 after the correction period T1-T3, the control pulse WS is switched on, which turns on the sampling transistor Tr1. As a result, the video signal Vsig supplied from the signal line SL is sampled by the capacitance element Cs2. Thus, the potential at the point A rises from Vth to the signal potential Vsig. In response to the potential rise, the potential at the point G also rises with maintaining the potential difference Vth. As the timing chart shows, the potential difference between the points A and G is kept at Vth even after the sampling. Subsequently, at the timing T5 after the elapse of one horizontal period, the control pulse WS is switched off and thus the sampling transistor Tr1 enters the non-conductive state. Since the sampling operation for sampling Vsig and storing it in Cs2 is implemented during a period T4-T5, this period is referred to as a sampling period. The length of the sampling period T4-T5 is equal to that of one horizontal period 1 H.

At the timing T6, the control signal DS is switched on again, which turns on the switching transistor Tr4. This switching causes the drive transistor Tr2 to supply the drain current Ids to the light-emitting element EL according to the potential difference Vgs between the potentials at the points S and G. Thus, the light-emitting element EL emits light with a luminance dependent upon Vgs.

At the timing T7, the field ends and the next field starts. Initially the reset period starts in the next field.

With reference to the timing chart of FIG. 3, the input potential Vgs during the sampling period T4-T5 and the subsequent emission period will be obtained below. The input potential Vgs is the potential at the point G relative to the potential at the point S. In the emission period after the sampling period T4-T5, the point S is connected to the power supply and therefore the potential thereat is Vcc since the transistor Tr4 is in the on-state. The potential at the point A is Vsig as described above. In addition, the potential at the point G is lower by Vth than the potential at the point A. Therefore, Vgs, which is the potential at the point G relative to the potential at the point S, equals Vcc−(Vsig−Vth). When the obtained Vcc−(Vsig−Vth) is substituted for Vgs of Transistor Characteristic Equation 1, the following Characteristic Equation 2 is obtained.

$$Ids=(1/2)\mu(W/L)Cox(Vcc-Vsig)^2 \qquad \text{Equation 2}$$

Referring to Characteristic Equation 2, the term (Vcc−Vsig) replaces the term (Vgs−Vth) included in Transistor Characteristic Equation 1 and therefore Vth is cancelled. Therefore, the pixel circuit 2 of FIG. 2 can supply the output current Ids dependent upon the value of Vsig to the light-emitting element EL independently of Vth of the drive transistor Tr2. Accordingly, even if Vth of the drive transistor Tr2 varies from pixel to pixel, the pixel array can supply an output current from which the variation has been eliminated to the light-emitting element EL of each pixel.

Figure 4:
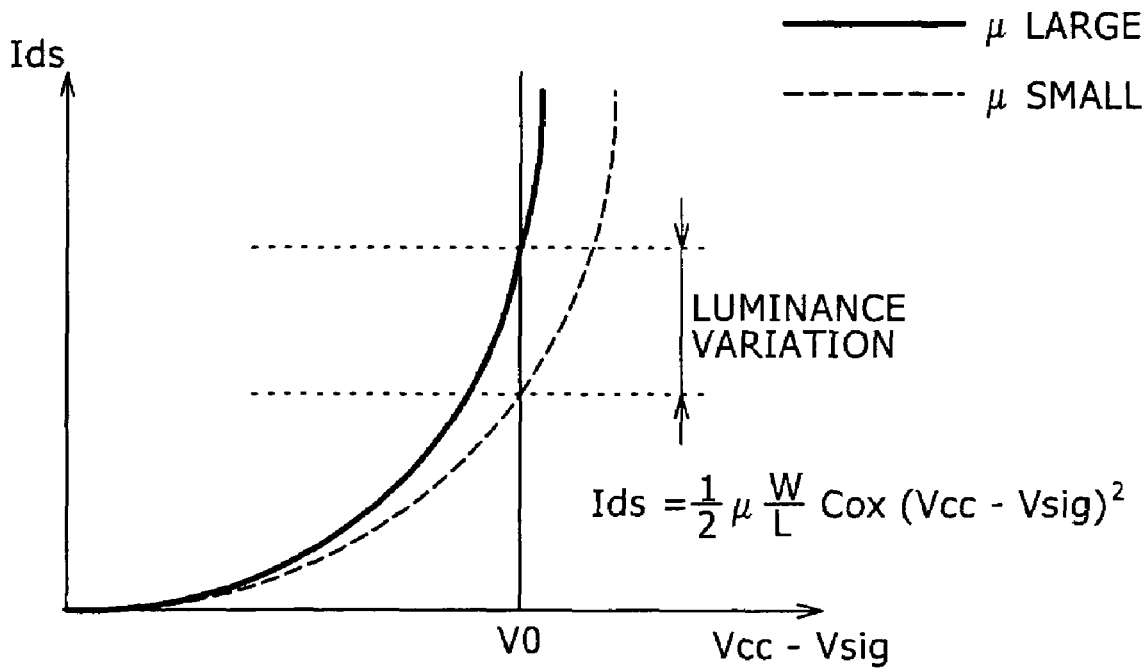
FIG. 4 is a graph illustrating the input voltage/output current characteristic of a drive transistor.

FIG. 4 is a graph of Characteristic Equation 2. The output current Ids is plotted on the ordinate and the input potential Vcc−Vsig on the abscissa. Characteristic Equation 2 is represented beside the graph. As Characteristic Equation 2 shows, the term including Vth of the drive transistor is absent. However, the mobility μ remains in the equation. The mobility μ depends on the device and varies from pixel to pixel as with Vth. Therefore, canceling only Vth does not lead to complete elimination of variation in the output current Ids. In the graph, the transistor characteristic with large μ is expressed with the full line while that with small μ is expressed with the dashed line. As is apparent from the graph, a larger coefficient μ of the characteristic equation leads to a steeper characteristic curve. Therefore, since there is variation in the mobility μ among pixels, the output current Ids varies depending on μ although Vcc−Vsig is constant (=V0), which results in luminance variation among pixels. In particular when Vcc−Vsig is a potential for displaying a gray-scale in a range of gray to white, the luminance variation depending on the mobility μ is significantly large and display unevenness arises, which should be solved.

Figure 5:
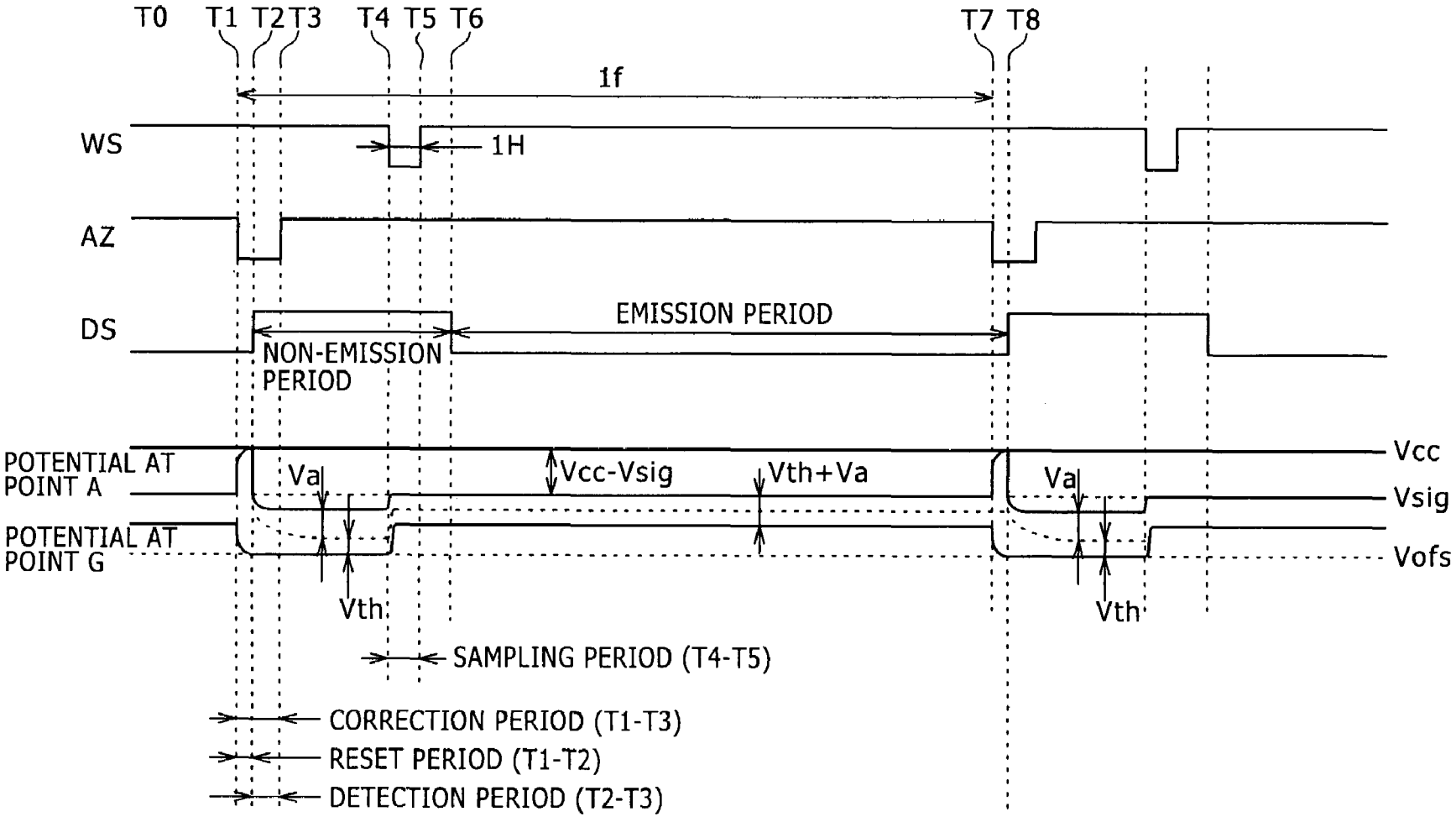
FIG. 5 is a timing chart explaining the operation of the pixel circuit of FIG. 2 according to an embodiment of the present invention.

FIG. 5 is a timing chart explaining the operation of the pixel circuit according to an embodiment of the invention. The configuration of the pixel circuit is the same as that shown in FIG. 2. However, the control sequence thereof is improved to allow canceling of variation in μ as well as Vth. In the same way as the timing chart of FIG. 3, the timing chart of FIG. 5 also illustrates the waveform changes of the control pulses WS, AZ and DS, and the potential changes at the points A and G. The potential at the point A in the pixel circuit according to the embodiment of the invention is expressed with the full line. In addition, for a better understanding, the potential change at the point A in the pixel circuit, described with FIG. 3, is expressed with the dashed line for comparison.

Initially, the potential change at the point A of the foregoing pixel circuit, represented with the dashed line, will be descried again. Initially Vofs is written to the point G during the reset period T1-T2. The potential at the point A becomes the same as the source potential, and reaches Vcc. The certain ground potential Vofs is set to such a potential to permit switching on of all the drive transistors (Vgs>Vth, i.e., Vcc−Vofs>Vth). During the reset period T1-T2, both the control pulses DS and AZ are "on".

When the sequence moves to the detection period T2-T3, the control pulse DS is switched off and thus the power supply to the drive transistor Tr2 is interrupted. The potential at the point A is discharged until the drive transistor Tr2 is cut off as shown with the dashed line. The potential at the point A after the cut off is Vofs+Vth, and therefore Vth is detected and stored. Subsequently, the control pulse AZ is turned off (refer to FIG. 3), and then the control pulse WS is turned on. Thus, the signal voltage Vsig is written to the point A and the potential at the point G becomes Vsig−Vth. Thereafter, during the emission period, the control pulse DS is switched on and the potential at the point S becomes Vcc. Therefore, the output current Ids flowing through the drive transistor Tr2 is represented by the above-described Characteristic Equation 2, which includes no term of Vth. Thus, deterioration of uniformity due to variation in Vth can be prevented. However, deterioration of uniformity due to variation in μ cannot be prevented.

Therefore, the embodiment of the invention significantly shortens the correction period T1-T3 defined by the control pulse AZ as shown in the timing chart of FIG. 5, to thereby correct the mobility μ simultaneously with the correction of Vth. As is apparent from the timing chart of FIG. 5, the shortening of the correction period T1-T3 also shortens the detection period T2-T3. Therefore, the drive transistor Tr2 is not cut off, and the potential at the point A at the end of the detection period T2-T3 is, as the full line shows, Vofs+Vth+Va, which is higher by the finite voltage Va than the above-described cut-off level. After the detection period T2-T3, as with the timing chart of FIG. 3, the sequence passes through the sampling period T4-T5 to reach the emission period, during which the emitting operation of the light-emitting element is implemented.

With reference to the timing chart of FIG. 5, the input potential Vgs during the sampling period T4-T5 and the subsequent emission period will be obtained below. The input potential Vgs is the potential at the point G relative to the potential at the point S. In the emission period after the sampling period T4-T5, the point S is connected to the power supply and therefore the potential thereat is Vcc since the transistor Tr4 is in the on-state. The potential at the point A is Vsig as described above. In addition, the potential at the point G is lower by Vth+Va than the potential at the point A. Therefore, Vgs, which is the potential at the point G relative to the potential at the point S, equals Vcc−(Vsig−(Vth+Va)). When the obtained Vcc−(Vsig−(Vth+Va)) is substituted for Vgs of Transistor Characteristic Equation 1, the following Characteristic Equation 3 is obtained.

$$Ids=(1/2)\mu(W/L)Cox(Vcc-Vsig+Va)^2 \qquad \text{Equation 3}$$

As is apparent from the comparison between Characteristic Equations 2 and 3, Characteristic Equation 3 has the voltage term additionally including Va although Vth is similarly canceled. That is, Characteristic Equation 3 results from addition of Va to Characteristic Equation 2. According to Characteristic Equation 3, the term Va for correcting the mobility shifts the luminance toward higher levels. Conventionally, the output current during the emission period is expressed by Characteristic Equation 2, and the condition for displaying black is Vsig=Vcc, in which Ids is zero. However, the embodiment of the present invention shortens the period for correcting Vth in order to correct the mobility, and therefore the output current during the emission period is expressed by Characteristic Equation 3. According to Characteristic Equation 3, light-emission arises under the conventional condition for displaying black, Vsig=Vcc, since the extra term Va exists. Therefore, in order to ensure completely no light-emission when displaying black also in the embodiment of the invention, the setting of the signal voltage when displaying black needs to be Vsig>Vcc.

Figure 6:
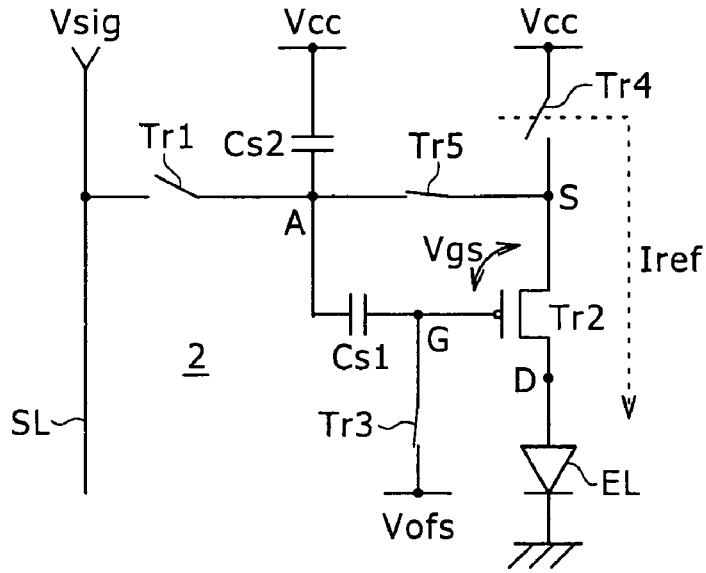
FIG. 6 is a circuit diagram explaining the operation of the pixel circuit of FIG. 2 according to an embodiment of the present invention.

The term Va added to Characteristic Equation 3 serves to reduce the contribution of the mobility μ in a coefficient part of Characteristic Equation 3. Thus, the embodiment of the invention can suppress the influence of not only variation in Vth but also variation in μ. Description will be made on how the presence of the term Va suppresses the influence of the mobility with reference to FIGS. 6 and 7. FIG. 6 is a circuit diagram illustrating the operational state of the pixel circuit 2 during the detection period. During the detection period, the sampling transistor Tr1 and the switching transistor Tr4 are "off" while the detection transistor Tr5 and the switching transistor Tr3 are "on" as described above. The drive transistor Tr2 is isolated from the power supply since the transistor Tr4 is "off". The gate G and source S of the drive transistor Tr2 is connected via the capacitance element Cs1 to each other since the detection transistor Tr5 is "on". The transient current flowing through the drive transistor Tr2 in this state is defined as Iref. If the changing potential at the point S is defined as Vs, and k as a coefficient of the drive transistor is defined as k=W/L·Cox, the transient current Iref flowing during the detection period is expressed by the following Characteristic Equation 4.

$$Iref=(1/2)k\mu(Vs-Vofs-Vth)^2 \qquad \text{Equation 4}$$

Since Vs is the potential at the point S and Vofs is the potential at the point G, Vs−Vofs in Characteristic Equation 4 indicates Vgs.

The point A of FIG. 6 has the same potential as that at the point S, and therefore the potential at the point A during the detection period T2-T3 shown in FIG. 5 is also represented as Vs. Therefore, Va corresponds to the potential obtained by subtracting Vofs and Vth from the potential Vs at the point A as is apparent from the timing chart of FIG. 5. Thus, Va=Vs−Vofs−Vth is obtained. The term (Vs−Vofs−Vth) is included in Characteristic Equation 4 and thus can be replaced by Va. As a result, Va is expressed as the following Equation 5.

$$Va=Vs-Vofs-Vth=(2Iref/k\mu)^{1/2} \quad \text{Equation 5}$$

Referring back to Characteristic Equation 3 including Va, substitution of Equation 5 for this Va results in the following Characteristic Equation 6.

$$Ids=(1/2)\mu(W/L)Cox(Vcc-Vsig+(2Iref/k\mu)^{1/2})^2 \quad \text{Equation 6}$$

Figure 7:
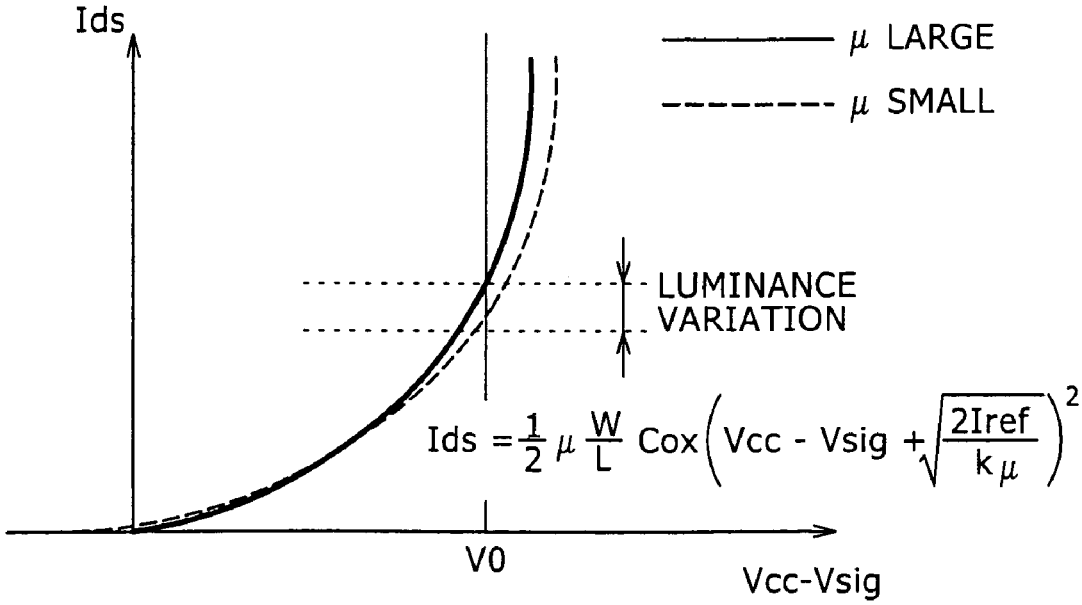
FIG. 7 is a graph illustrating the input voltage/output current characteristic of a drive transistor according to an embodiment of the present invention.

FIG. 7 is a graph illustrating the current/voltage characteristic of the drive transistor, expressed by Characteristic Equation 6. Characteristic Equation 6 is represented beside the graph. The graph corresponds to the graph of FIG. 4. The output current Ids is plotted on the ordinate and the input potential Vcc−Vsig on the abscissa. The full line characteristic curve corresponds to the maximum mobility μ in the range of mobility variation, and the dashed line curve to the minimum mobility. The characteristic curves expressed by Characteristic Equation 6 result from a shift, relative to the curves of FIG. 4, in the negative direction of the abscissa by Va included in the voltage term. Since Va includes the mobility g in the denominator thereof, a higher mobility μ leads to a lower Va while a lower mobility μ leads to a higher Va. Thus, the shift amount of the characteristic curve differs depending on the mobility. This shift amount difference serves to reduce the influence of the mobility μ. As shown in the graph of FIG. 7, the I/V characteristic curves having the different mobility μ intersect each other in a gray displaying region. Thus, compared with the characteristic curves shown in FIG. 4, variation in the output current due to variation in the mobility μ can be suppressed in a range from a gray displaying region to a white displaying region. Therefore, an organic EL panel having no luminance variation and excellent uniformity can be obtained.

As is apparent from the above description, in order to simultaneously correct both the threshold voltage Vth and the mobility μ, the potential between the gate and source needs to be detected and stored during the period when a transient current flows through the drive transistor. Therefore, the detection period needs to be set short within an adequate range. For this purpose, the peripheral scanners for controlling the operational timing for the pixel circuit need to have inventive features. The following description relates to this respect. Referring back to the reference example of FIG. 1, the clocks CK and CKX are commonly used for the write scanner 4, the drive scanner 5 and the correction scanner 7 in order to reduce the number of clocks to the scanner part. Therefore, the time resolution of timing control for the pixel circuit 2 cannot be set more minute than the half period of the clocks CK and CKX in principle. Because of this limitation, the configuration of the peripheral scanner part of FIG. 1 is inadequate.

Figure 8:
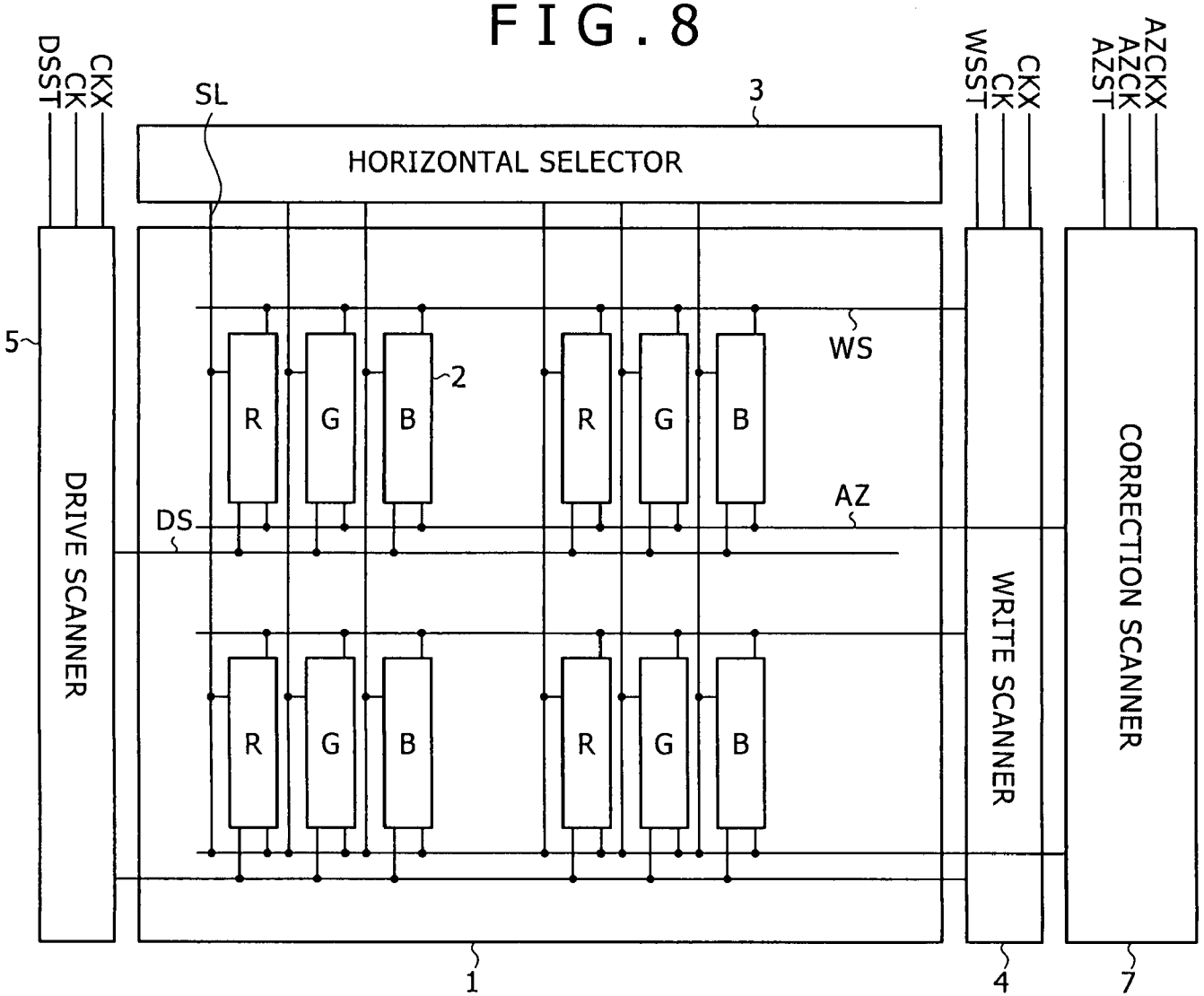
FIG. 8 is a block diagram illustrating a display according to an embodiment of the invention.

In contrast, in the display of the embodiment of the invention shown in FIG. 8, different clocks are used for the write scanner 4 and the correction scanner 7 instead of using the common clocks CK and CKX for all the scanners. Referring to FIG. 8, the write scanner 4 is externally supplied with the clocks CK and CKX common to the drive scanner 5, while the correction scanner 7 is supplied with clocks AZCK and AZCKX different from the clocks CK and CKX. The clocks AZCK and AZCKX have the same period as that of the clocks CK and CKX but have a phase different from that of the clocks CK and CKX. This phase difference allows minute control of the control timing for the pixel circuit 2 with a time resolution shorter than the half period of the clocks.

Figure 9:
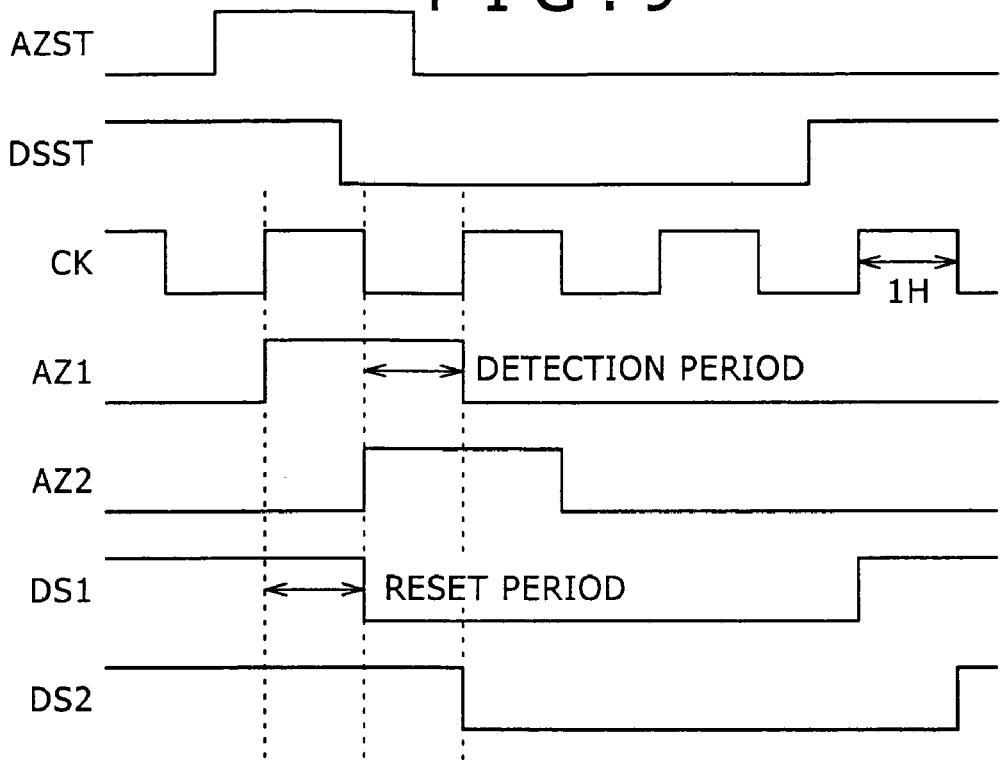
FIG. 9 is a timing chart explaining the operation of the display of FIG. 1.

FIG. 9 is a timing chart explaining the operation of the scanner part of FIG. 1. In order to facilitate understanding, the timing chart is illustrated based on a positive logic and therefore high and low levels of each pulse waveform correspond to "on" and "off", respectively. The correction scanner 7 is supplied with the start pulse AZST while the drive scanner 5 is supplied with another start pulse DSST as described above. Both scanners are supplied with the common clock CK. The period of the clock CK is defined as 2H. The correction scanner 7 latches the start pulse AZST at an edge of the clock CK, and sequentially transfers the start pulse AZST to output the correction control pulse AZ to pixels for each row. The timing chart represents control pulses AZ1 and AZ2 that are output to the first and second rows, respectively. Similarly the drive scanner 5 sequentially transfers the start pulse DSST in synchronized with the clock CK, to output the drive control pulses DS1, DS2 and so on. For example, the pulse width of AZ1 defines the correction period for the first row. The reset period and detection period included in the correction period are differentiated by the control pulse DS1. As a result, the time length of the detection period is at least 1 H. As long as the clock CK is commonly used for the correction scanner 7 and the drive scanner 5, the time length of the detection period cannot be set shorter than 1 H in principle.

In order to obtain the finite Va including information of both Vth and μ, a short detection period is required. The detection period adequate to correct variation in the mobility μ ranges from about several microseconds to about 20 μs, depending on the parameters. In contrast, typically the length of 1 H period is 20-50 μs, depending on the field frequency and the number of pixels. In most panels, therefore, the detection period needs to be shorter than 1 H to implement optimum correction of mobility variation. However, conventional timing control of FIG. 9 involves difficulties of achieving the shorter detection period. Commonly using the same clock CK of the same phase results in a detection period whose length is an integral multiple of half period of the clock pulse, and therefore is at least 1 H. The 1 H period has a length of 20-40 μs, depending on the frequency of the panel. This length is insufficient to correct mobility variation.

Figure 10:
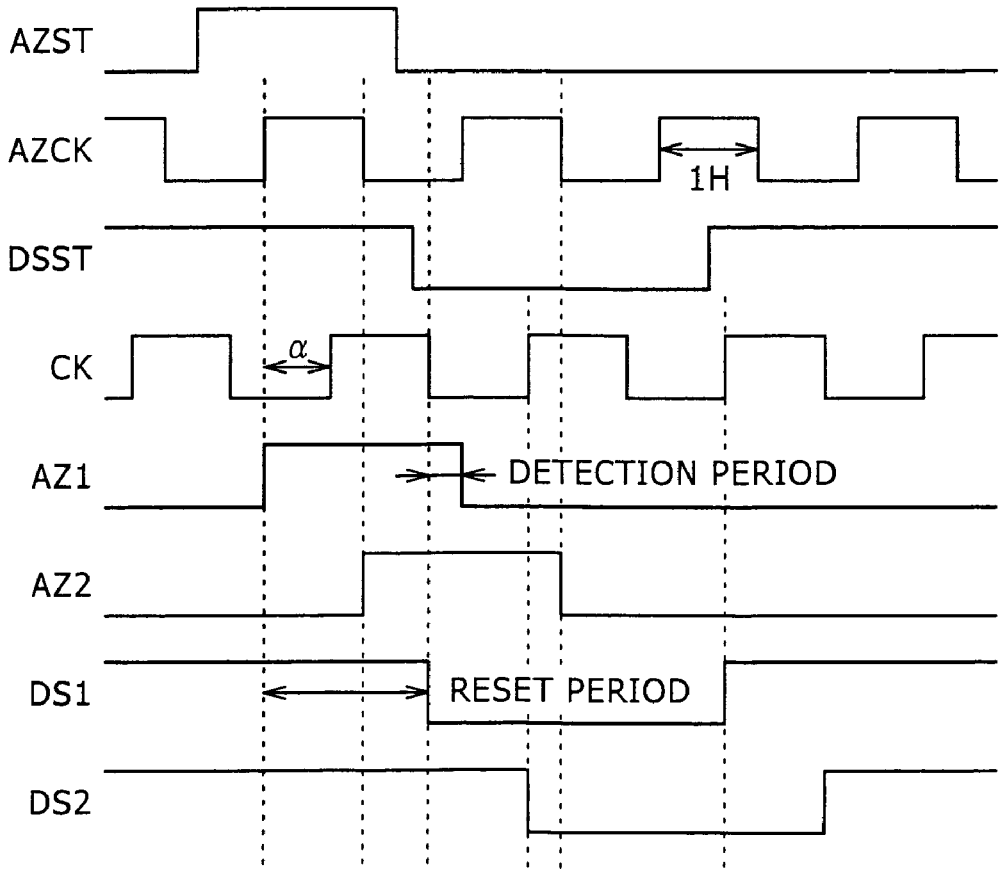
FIG. 10 is a timing chart explaining the operation of the display of FIG. 8.

FIG. 10 is a timing chart explaining the operation of the scanner part of the display according to the embodiment of the invention shown in FIG. 8. For a better understanding, the same parts as those in the timing chart of FIG. 9 are given the same numerals. FIG. 10 is different from FIG. 9 in that the correction scanner 7 receives the clock AZCK different from the clock CK input to the drive scanner 5. The clocks AZCK and CK have the same frequency but have different phases varying by α. Changing this phase difference α can freely vary the overlap between the correction control pulse AZ1 and the drive control pulse DS1. As a result, the detection period can be set shorter than 1 H, which allows sufficient correction of mobility variation. However, shortening the detection period correspondingly leads to a longer reset period. During the reset period, a through-current flows in the drive transistor and is supplied to the light-emitting element EL. The through-current causes anomalous light-emission of the light-emitting element EL, which results in floating black on the screen.

Figure 11:
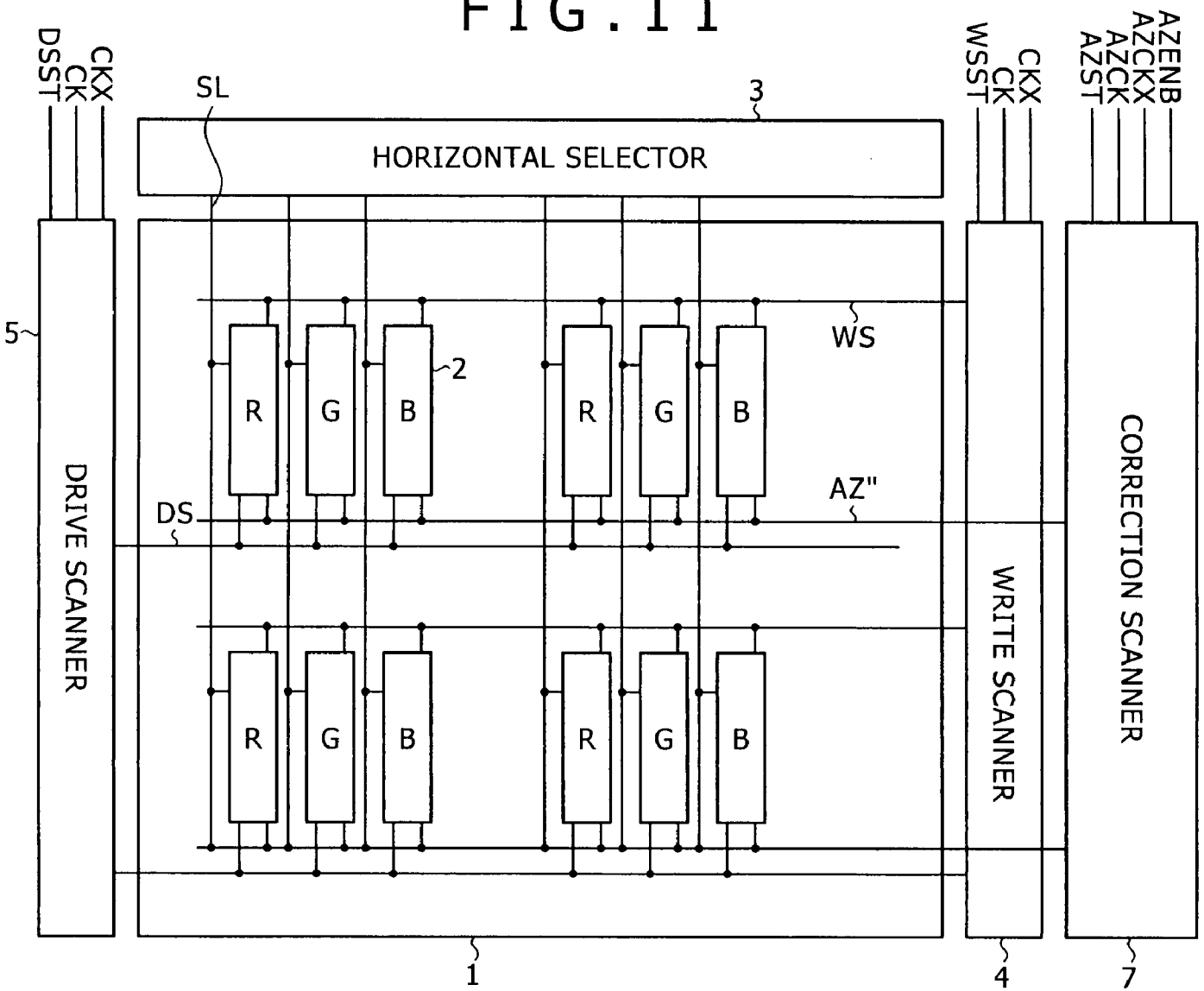
FIG. 11 is a block diagram illustrating a display according to another embodiment of the present invention.

A display shown in FIG. 11 is an embodiment for eliminating this disadvantage and allowing shortening of a reset period. Basically, the embodiment of FIG. 11 is the same as the preceding embodiment of FIG. 8. The difference therebetween is that in the embodiment of FIG. 11, a signal AZENB for limitation is input to the correction scanner 7 in order to shorten the reset period.

Figure 12:
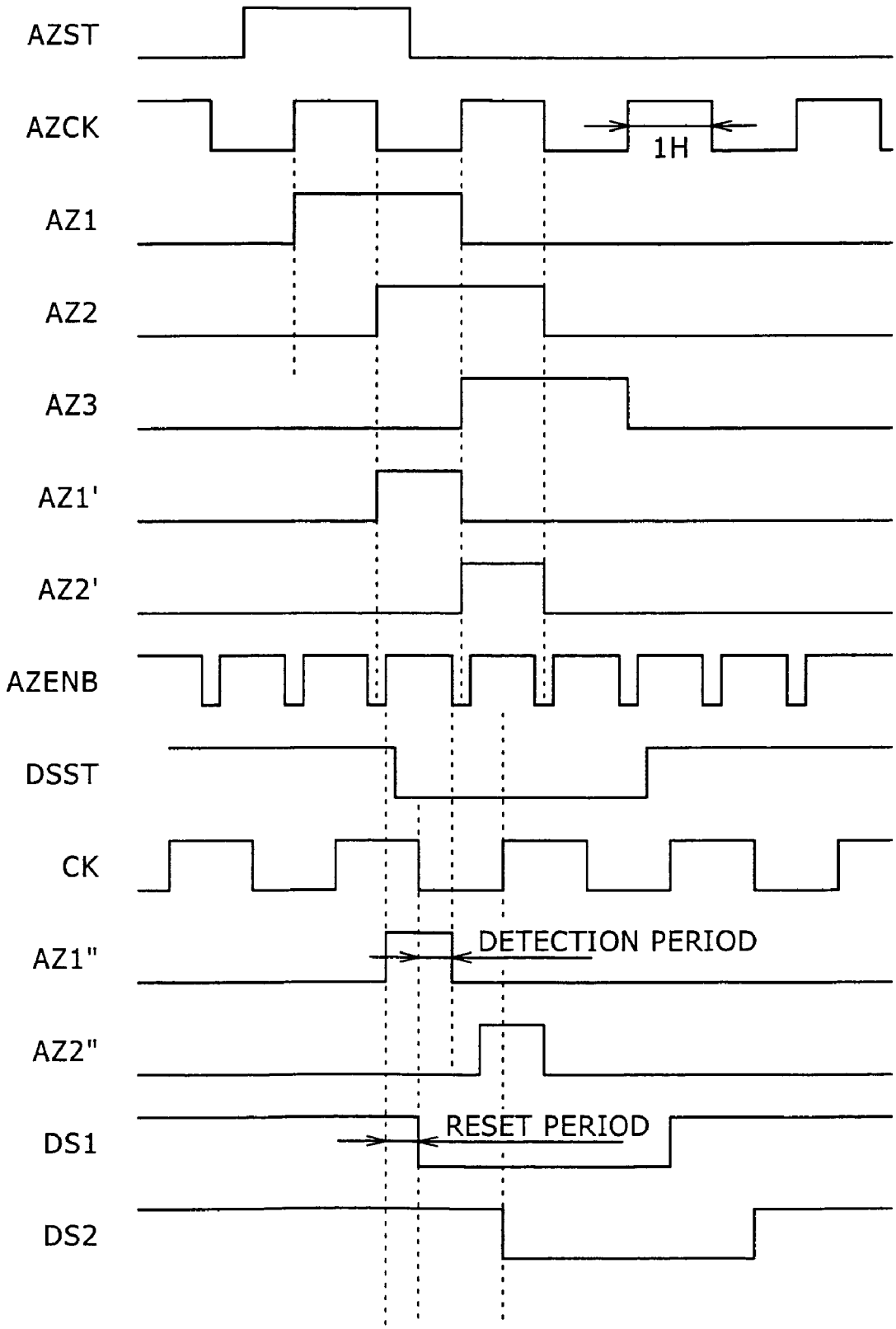
FIG. 12 is a timing chart explaining the operation of the display of FIG. 11.

Referring to a timing chart of FIG. 12, the operation of the scanner part of the display of FIG. 11 will be described. In order to facilitate understanding, the same pulses as those in the timing chart of the preceding embodiment shown in FIG. 10 are given the same numerals. The correction scanner 7 of FIG. 11 is supplied with the pulse AZENB for limitation in addition to the start pulse AZST and the clock pulse AZCK. The correction scanner 7 sequentially transfers the start pulse AZST in sync with the clock AZCK, and sequentially outputs primary control pulses AZ1, AZ2, AZ3 and so on in a period of 1 H from each stage of the shift register. AND operation of AZ1 and AZ2 is executed to produce a secondary control pulse AZ1'. Similarly, AND operation of the primary control pulses AZ2 and AZ3 is executed to obtain a secondary control pulse AZ2'. The pulse width of the secondary control signals AZ1', AZ2' and so on is 1 H as shown in the drawing. Furthermore, AND operation of the secondary control pulse AZ1' and the clock pulse AZENB for limitation is executed to obtain a tertiary control signal AZ1". Similarly, AND operation of the secondary control pulse AZ2' and AZENB is executed to obtain the next tertiary control pulse AZ2". The pulse width of the tertiary control pulses. AZ1", AZ2" and so on is smaller than 1 H as is apparent from the timing chart. The tertiary control pulses AZ1", AZ2" and so on are sequentially supplied in a period of 1 H to the pixels of the respective rows of the pixel array. The drive scanner 5 sequentially transfers the start pulse DSST in sync with the clock CK, and supplies control pulses DS1, DS2 and so on to the pixels of the respective rows of the pixel array in a period of 1 H. The overlap between AZ1" and DS1 corresponds to the reset period for the pixels of the first row. Since the pulse width of AZ1" is limited to be shorter than 1 H, the reset period is made shorter than 1 H. Shortening the reset period in such a manner allows suppression of floating black. In addition, shortening of the detection period is also allowed to thereby enable correction of both the threshold voltage and mobility. Thus, a display of high uniformity can be obtained.

Figure 13:
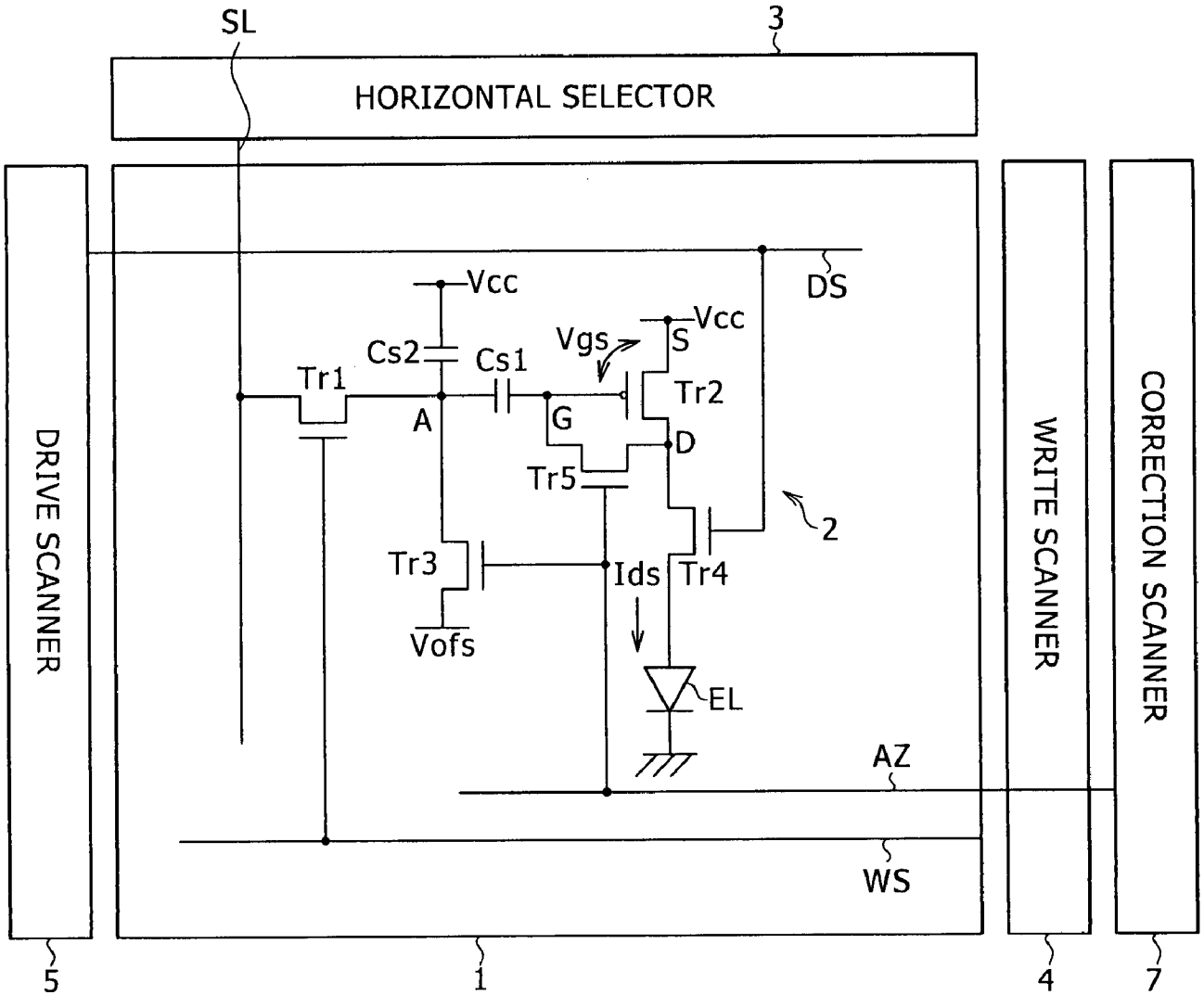
FIG. 13 is a circuit diagram illustrating a pixel circuit according to another embodiment of the present invention.

In the pixel circuit of FIG. 2, all the transistors are a P-channel thin film transistor. The invention is not limited thereto but can also employ N-channel transistors. FIG. 13 illustrates another embodiment of the pixel circuit. For a better understanding, the same parts as those in the pixel circuit of FIG. 2 are given the same numerals. Referring to FIG. 13, the pixel circuit 2 is composed of five thin film transistors Tr1 to Tr5, two capacitance elements Cs1 and Cs2, and one light-emitting element EL. Of five transistors, only the drive transistor Tr2 is a P-channel transistor, and the sampling transistor Tr1, the switching transistor Tr3, the switching transistor Tr4 and the detection transistor Tr5 are N-channel transistors. The capacitance elements Cs1 and Cs2 constitute a capacitance part. The detection transistor Tr5 and the switching transistor Tr3 constitute a correction section.

The source (point S) of the drive transistor Tr2 is connected to a supply potential Vcc, and the drain (point D) thereof is connected via the switching transistor Tr4 to the anode of the light-emitting element EL. The gate (point G) of the drive transistor Tr2 is connected via the detection transistor Tr5 to the point D.

The sampling transistor Tr1 is connected between the signal line SL and a point A. The capacitance element Cs2 is connected between the point A and the supply potential Vcc. The capacitance element Cs1 is connected between the points A and G. The switching transistor Tr3 is connected between the point A and a certain offset potential Vofs.

The peripheral scanner part includes the write scanner 4, the drive scanner 5 and the correction scanner 7. The write scanner 4 controls switching on and off of the sampling transistor Tr1 via the scan line WS. The drive scanner 5 controls switching on and off of the switching transistor Tr4 via the scan line DS. The correction scanner 7 controls switching on and off of the detection transistor Tr5 and the switching transistor Tr3 via the scan line AZ. By adequately setting the control sequence of the write scanner 4, the drive scanner 5 and the correction scanner 7, the detection period can be shortened and thus Vth and μ of the drive transistor Tr2 can simultaneously be corrected.

As described above, the display according to the embodiment of the invention is basically composed of the pixel array part 1, scanner part and signal part. The pixel array part 1 includes the scan lines WS, DS and AZ disposed on rows, signal lines SL disposed on columns, and a matrix of the pixel circuits 2 disposed at intersections between the scan and signal lines. The signal part is composed of the horizontal selector 3, and supplies the video signals Vsig to the signal lines DS. The scanner part supplies control pulses to the scan lines WS, DS and AZ, to sequentially scan the pixel circuits 2 for each row.

Each pixel circuit 2 includes at least the sampling transistor Tr1, the capacitance part Cs1 and Cs2, the drive transistor Tr2 and the light-emitting element EL. The sampling transistor Tr1 conducts in response to the sampling control pulse supplied from the scan line WS to sample the video signal Vsig supplied from the signal line SL during a certain sampling period. The capacitance part Cs1 and Cs2 holds the input potential Vgs dependent upon the sampled video signal Vsig. The drive transistor Tr2 supplies the output current Ids during a certain emission period according to the input potential Vgs held by the capacitance part Cs1 and Cs2. The output current Ids has dependence on the carrier mobility μ in the channel region of the drive transistor Tr2 and dependence on the threshold voltage Vth of the drive transistor Tr2 as indicated by Transistor Characteristic Equation 1. The output current Ids supplied from the drive transistor Tr2 causes the light-emitting element EL to emit light with a luminance dependent upon the video signal Vsig.

The pixel circuit 2 includes the correction section for simultaneously correcting both the dependence of the output current Ids on the carrier mobility μ and that on the threshold voltage Vth. This correction section is made up of the detection transistor Tr5 and the switching transistor Tr3. The pixel circuit 2 also includes the transistor Tr4 to thereby switch the emission period and non-emission period of the light-emitting element EL. The correction section (Tr5 and Tr3) is connected to the drive transistor Tr2 and the capacitance part (Cs1 and Cs2), and operates during the correction period T1-T3 preceding to the sampling period T4-T5. The correction period T1-T3 is separated into the reset period T1-T2 and the detection period T2-T3. During the reset period T1-T2, the correction section (Tr5 and Tr3) energizes the capacitance part (Cs1 and Cs2), to thereby reset the potential held by the capacitance part. During the subsequent detection period T2-T3, the correction section (Tr5 and Tr3) stops the energization and detects the potential difference arising between the source (point S) and gate (point G) of the drive transistor Tr2 during the period when the transient current Iref flows through the drive transistor Tr2. The capacitance part (Cs1 and Cs2) holds the potential Vth+Va corresponding to the detected potential difference. The held potential Vth+Va includes both potential components Vth and Va for reducing the influence of the threshold voltage Vth and the influence of the carrier mobility μ, respectively, on the output current Ids of the drive transistor Tr2.

The scanner part includes at least the write scanner 4, the drive scanner 5 and the correction scanner 7. The write scanner 4 supplies the sampling control pulses to the scan lines WS during the sampling period T4-T5. The correction scanner 7 supplies the correction control pulses defining the correction period T1-T3 to the scan lines AZ. The drive scanner 5 supplies the drive control pulses to the scan lines DS. The drive control pulse differentiates the reset period T1-T2 from the detection period T2-T3 in the correction period T1-T3, and differentiates the emission period T6-T8 from the non-emission period T2-T6.

The correction scanner 7 operates in sync with the first clock AZCK, and sequentially supplies one of the respective correction control pulses AZ1, AZ2 and so on to the scan line AZ of one of the respective rows in each one horizontal period (1 H). The drive scanner 5 operates in sync with the second clock CK, and sequentially supplies one of the respective drive control pulses DS1, DS2 and so on to the scan line DS of one of the respective rows in each one horizontal period (1 H). The first and second clocks AZCK and CK have the same period (2H), but have different phases varying by α. By utilizing this phase difference, the time length of the detection period, defined by the correction control pulse AZ1 and the drive control pulse DS1, is set shorter than one horizontal period (1 H). This shortening allows simultaneous correction of both the dependence of the output current Ids on the carrier mobility μ and that on the threshold voltage Vth. In addition, the scanner part can adjust the phase difference a between the first and second clocks AZCK and CK, and therefore allows adequate setting of the time length of the detection period. Thus, both the dependence of the output current Ids on the carrier mobility μ and that on the threshold voltage Vth can simultaneously be corrected. Preferably, the correction scanner 7 includes a unit for limiting the time length of the correction control pulses AZ1, AZ2 and so on. Thus, the time length of the reset period is shortened to thereby suppress a through-current arising from the energization and flowing through the drive transistor Tr2 to the light-emitting element EL during the reset period, which suppresses anomalous light-emission of the light-emitting element EL attributed to the through-current.

What is claimed is:

1. A pixel circuit disposed at an intersection between a row scan line that supplies a control pulse and a column signal line that supplies a video signal, comprising:

a sampling transistor conducting in response to the control pulse supplied from the scan line to sample the video signal supplied from the signal line during a certain sampling period;

a capacitance part holding an input potential dependent upon the sampled video signal;

a drive transistor supplying an output current during a certain emission period according to the input potential held by the capacitance part, the output current having dependence on a carrier mobility in a channel region of the drive transistor and dependence on a threshold voltage of the drive transistor;

a light-emitting element caused, by the output current supplied from the drive transistor, to emit light with a luminance in response to the video signal; and correction means correcting both the dependence of the output current on the carrier mobility and the dependence of the output current on the threshold voltage simultaneously, the pixel circuit including at least the sampling transistor, the capacitance part and the drive transistor, wherein the correction means is connected to the drive transistor and the capacitance part, and operates during a correction period preceding to the sampling period, the correction period being separated into a reset period and a detection period;

during the reset period, the correction means energizes the capacitance part to reset the potential held by the capacitance part;

during the detection period, the correction means stops the energization and detects a potential difference arising between a source and a gate of the drive transistor during a period when a transient current flows through the drive transistor; and the capacitance part holds a potential corresponding to the detected potential difference, the held potential including both a potential component for reducing influence of the threshold voltage on the output current of the drive transistor, and a potential component for reducing influence of the carrier mobility on the output current of the drive transistor.

2. The pixel circuit according to claim 1, wherein the detection period is designed to have a time length shorter than a time length of the sampling period, to thereby allow the correction means to correct both the dependence of the output current on the carrier mobility and the dependence of the output current on the threshold voltage simultaneously.

3. The pixel circuit according to claim 1, wherein a time length of the reset period is limited to cause the correction means to suppress a through-current arising from the energization and flowing through the drive transistor to the light-emitting element during the reset period, to thereby suppress anomalous light-emission of the light-emitting element attributed to the through-current.

4. The pixel circuit according to claim 1, wherein a potential level of the video signal when displaying black is set higher than a certain supply potential in order to prevent light-emission of the light-emitting element due to the potential component for reducing the influence of the carrier mobility, of the potential held by the capacitance part.

5. A display comprising:

a pixel array part including scan lines disposed on rows, signal lines disposed on columns, and a matrix of pixels disposed at intersections between the scan and signal lines;

a signal part supplying a video signal to the signal lines; and a scanner part supplying a control pulse to the scan lines to sequentially scan the pixels for each row, wherein:

each of the pixels includes at least a sampling transistor, a capacitance part, a drive transistor, and a light-emitting element;

the sampling transistor conducts in response to a sampling control pulse supplied from the scan line to sample the video signal supplied from the signal line during a certain sampling period;

the capacitance part holds an input potential dependent upon the sampled video signal;

the drive transistor supplies an output current during a certain emission period according to the input potential held by the capacitance part, the output current having dependence on a carrier mobility in a channel region of the drive transistor and dependence on a threshold voltage of the drive transistor;

the light-emitting element is caused, by the output current supplied from the drive transistor, to emit light with a luminance in response to the video signal;

each of the pixels includes correction means that corrects both the dependence of the output current on the carrier mobility and the dependence of the output current on the threshold voltage simultaneously;

the correction means is connected to the drive transistor and the capacitance part, and operates during a correction period preceding to the sampling period, the correction period being separated into a reset period and a detection period;

during the reset period, the correction means energizes the capacitance part to reset the potential held by the capacitance part;

during the detection period, the correction means stops the energization and detects a potential difference arising between a source and a gate of the drive transistor during a period when a transient current flows through the drive transistor;

the capacitance part holds a potential corresponding to the detected potential difference, the held potential including both a potential component for reducing influence of the threshold voltage on the output current of the drive transistor, and a potential component for reducing influence of the carrier mobility on the output current of the drive transistor;

the scanner part including at least a write scanner, a drive scanner, and a correction scanner;

the write scanner supplies the sampling control pulse to the scan lines during the sampling period;

the correction scanner supplies a correction control pulse that defines the correction period to the scan lines; and the drive scanner supplies a drive control pulse to the scan lines, the drive control pulse differentiating the reset period from the detection period in the correction period and differentiating an emission period from a non-emission period other than the emission period.

6. The display according to claim 5, wherein:

the correction scanner operates in sync with a first clock to sequentially supply the correction control pulse to the scan line of one of the respective rows in each one horizontal period;

the drive scanner operates in sync with a second clock to sequentially supply the drive control pulse to the scan line of one of the respective rows in each one horizontal period; and the first and second clocks have a same period and have a phase difference, and by utilizing the phase difference, the detection period defined by the correction control pulse and the drive control pulse is designed to have a time length shorter than the one horizontal period, to thereby allow simultaneous correction of both the dependence of the output current on the carrier mobility and the dependence of the output current on the threshold voltage.

7. The display according to claim 6, wherein the scanner part adjusts the phase difference between the first and second clocks to adequately set the time length of the detection period, to thereby allow simultaneous correction of both the dependence of the output current on the carrier mobility and the dependence of the output current on the threshold voltage.

8. The display according to claim 6, wherein the correction scanner includes a unit for limiting a time length of the correction control pulse, to shorten a time length of the reset period for suppressing a through-current arising from the energization and flowing through the drive transistor to the light-emitting element during the reset period, to thereby suppress anomalous light-emission of the light-emitting element attributed to the through-current.

9. The display according to claim 5, the signal part sets a potential level of the video signal when displaying black higher than a certain supply potential in order to prevent light-emission of the light-emitting element due to the potential component for reducing the influence of the carrier mobility, of the potential held by the capacitance part.

10. A method of driving a pixel circuit disposed at an intersection between a row scan line that supplies a control pulse and a column signal line that supplies a video signal, the pixel circuit including at least a sampling transistor, a capacitance part, a drive transistor and a light-emitting element, the sampling transistor conducting in response to the control pulse supplied from the scan line to sample the video signal supplied from the signal line during a certain sampling period, the capacitance part holding an input potential dependent upon the sampled video signal, the drive transistor supplying an output current during a certain emission period according to the input potential held by the capacitance part, the output current having dependence on a carrier mobility in a channel region of the drive transistor and dependence on a threshold voltage of the drive transistor, the light-emitting element being caused, by the output current supplied from the drive transistor, to emit light with a luminance in response to the video signal, the method comprising the steps of:

correcting both the dependence of the output current on the carrier mobility and the dependence of the output current on the threshold voltage simultaneously during a correction period preceding to the sampling period, the correction period being separated into a reset period and a detection period, the correction step including the sub steps of: energizing the capacitance part to reset the potential held by the capacitance part during the reset period; and stopping the energization and detecting a potential difference arising between a source and a gate of the drive transistor during a period when a transient current flows through the drive transistor during the detection period; and holding a potential corresponding to the detected potential difference in the capacitance part, the held potential including both a potential component for reducing influence of the threshold voltage on the output current of the drive transistor, and a potential component for reducing influence of the carrier mobility on the output current of the drive transistor.

11. A method of driving a display including a pixel array part, a scanner part and a signal part, the pixel array part including scan lines disposed on rows, signal lines disposed on columns, and a matrix of pixels disposed at intersections between the scan and signal lines, the signal part supplying a video signal to the signal lines, the scanner part supplying a control pulse to the scan lines to sequentially scan the pixels for each row, each of the pixels including at least a sampling transistor, a capacitance part, a drive transistor and a light-emitting element, the sampling transistor conducting in response to a sampling control pulse supplied from the scan line to sample the video signal supplied from the signal line during a certain sampling period, the capacitance part holding an input potential dependent upon the sampled video signal, the drive transistor supplying an output current during a certain emission period according to the input potential held by the capacitance part, the output current having dependence on a carrier mobility in a channel region of the drive transistor and dependence on a threshold voltage of the drive transistor, the light-emitting element being caused, by the output current supplied from the drive transistor, to emit light with a luminance in response to the video signal, the method comprising the steps of:

correcting at each pixel both the dependence of the output current on the carrier mobility and the dependence of the output current on the threshold voltage simultaneously during a correction period preceding to the sampling period, the correction period being separated into a reset period and a detection period, the correction step including the sub steps of: energizing the capacitance part to reset the potential held by the capacitance part during the reset period; and stopping the energization and detecting a potential difference arising between a source and a gate of the drive transistor during a period when a transient current flows through the drive transistor during the detection period;

holding a potential corresponding to the detected potential difference in the capacitance part, the held potential including both a potential component for reducing influence of the threshold voltage on the output current of the drive transistor, and a potential component for reducing influence of the carrier mobility on the output current of the drive transistor;

supplying the sampling control pulse to the scan lines during the sampling period;

supplying a correction control pulse that defines the correction period to the scan lines; and supplying a drive control pulse to the scan lines, the drive control pulse differentiating the reset period from the detection period in the correction period and differentiating an emission period from a non-emission period other than the emission period.

* * * * *